US006467455B1

(12) United States Patent
Posh

(10) Patent No.: US 6,467,455 B1
(45) Date of Patent: Oct. 22, 2002

(54) FOUR-STROKE INTERNAL COMBUSTION ENGINE

(75) Inventor: Raymond C. Posh, 2401 Sharon Dr., Cedar Park, TX (US) 78613

(73) Assignees: Raymond C. Posh, Cedar Park, TX (US); David Raymond Posh, Cedar Park, TX (US)

( * ) Notice: Subject to any disclaimer, the term of this patent is extended or adjusted under 35 U.S.C. 154(b) by 0 days.

(21) Appl. No.: 09/721,727

(22) Filed: Nov. 27, 2000

(51) Int. Cl.[7] ..... F02B 75/02
(52) U.S. Cl. ..... 123/317; 123/80 BA

(58) Field of Search ..... 123/190.11, 80 BA, 123/80 D, 317, 318

(56) References Cited

U.S. PATENT DOCUMENTS 3,522,797 A * 8/1970 Stinebaugh ..... 123/317

* cited by examiner

*Primary Examiner*—Noah P. Kamen

(57) ABSTRACT

A four-stroke engine constructed using a gear with a port synchronized to the crankshaft by a power gear, and channels to direct the intake gases from the crankshaft housing into the combustion cylinder and to direct the exhaust gases out of the combustion cylinder into the atmosphere.

6 Claims, 2 Drawing Sheets

FOUR-STROKE INTERNAL COMBUSTION ENGINE

BACKGROUND OF THE INVENTION

TECHNICAL FIELD

This invention relates to internal combustion engines, which are employed in model aviation airplanes or other applications that can utilize two-stroke or four-stroke internal combustion engines. The four-stroke internal combustion engines are more desirable for their quietness of operation and high torque ability at lower Revolutions Per Minute. The four-stroke internal combustion engines that are currently available are heavier than desired and require constant maintenance and adjustment of the gears, cams, valves, valve seats, push rods, rod bearings, springs, rocker arms, bolts, lock nuts and various other parts.

REFERENCE CITED

United States Patents

U.S. Pat. No. 968,200 August 1910 Scott . . . 123/73

U.S. Pat. No. 1,165,135 December 1915 Seitz . . . 123/78

U.S. Pat. No. 3,418,993 December 1968 Scheiterlein et al . . . 123/195

U.S. Pat. No. 4,907,544 March 1990 Burrahm . . . 123/26

BRIEF SUMMARY OF THE INVENTION

The present invention provides a four-stroke internal combustion engine with means for the injection of a fuel and air mixture into the combustion chamber of the engine using stationary port placement and synchronized port rotation using gears. An Important feature of the present invention is that it requires no cams, push rods, rocker arms, springs or valves.

DESCRIPTION OF THE DRAWINGS

Other objects and attendant advantages of the present invention will be readily appreciated as the same becomes better understood by reference to the following detailed description when considered in connection with the accompanying drawings wherein.

DESCRIPTION OF THE INVENTION

Figure 1:
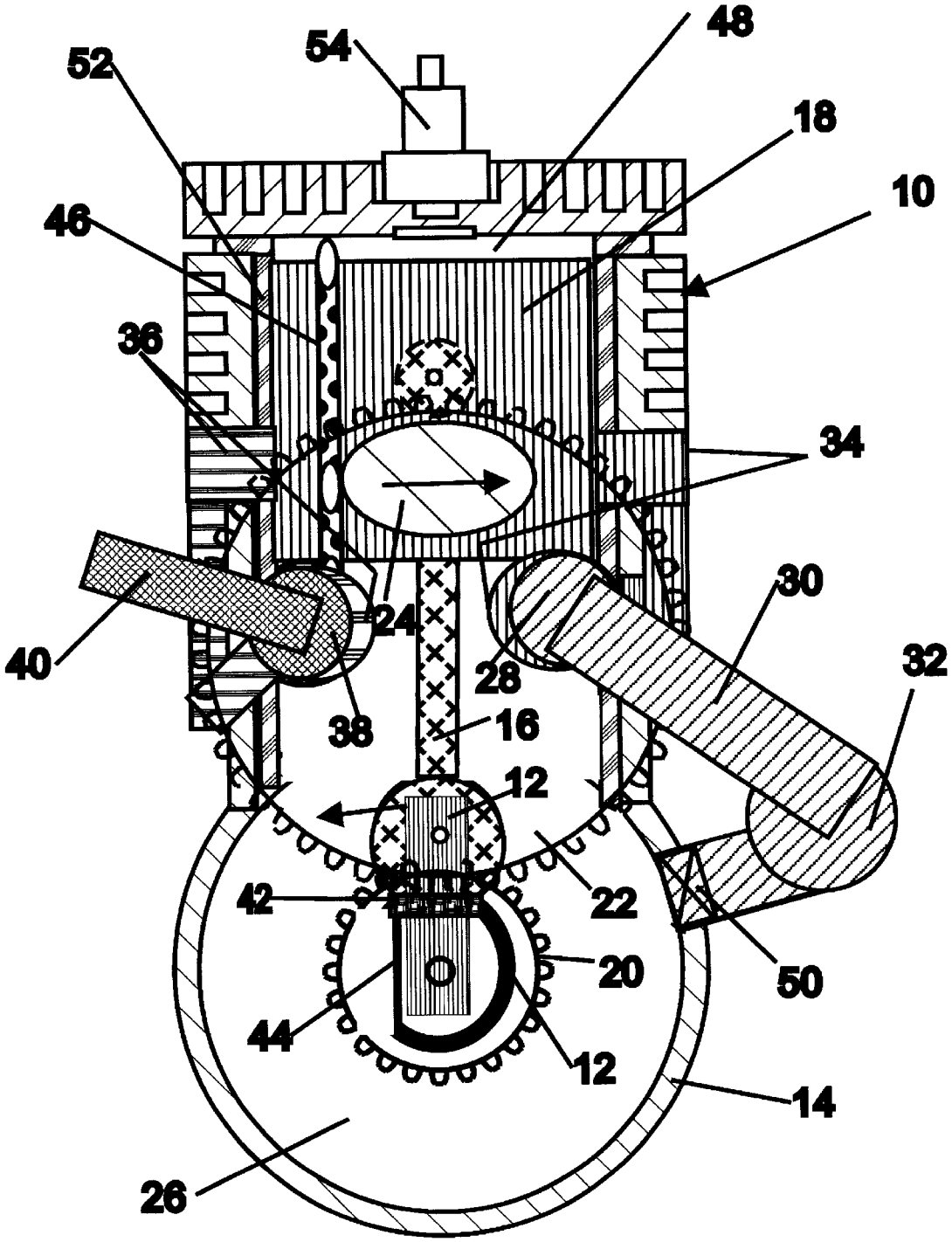
FIG. 1 is a view of a preferred embodiment of the instant invention.

Referring to the drawings, wherein like numerals indicate like or corresponding parts, a preferred embodiment of the four-stroke internal combustion engine is generally shown at 10 of FIG. 1.

The engine includes a hollow crankshaft 12, which is disposed in the engine housing or block 14 the same as a two-stroke internal combustion engine. The piston rod 16 connects the hollow crankshaft 12 to the piston 18. The power gear 20 is mounted to the hollow crankshaft 12 so as to rotate with it. The ported gear 22 with the port 24 is rotably mounted in the engine housing 14 and engaged with the power gear 20 so as to rotate one-half of a rotation every time the hollow crankshaft 12 and power gear 20 rotates one whole revolution.

The gear cover 56 is mounted on the engine housing 10 and contains the port 28, channel 30, port 38, channel 40 and gear bearing 58.

Figure 2:
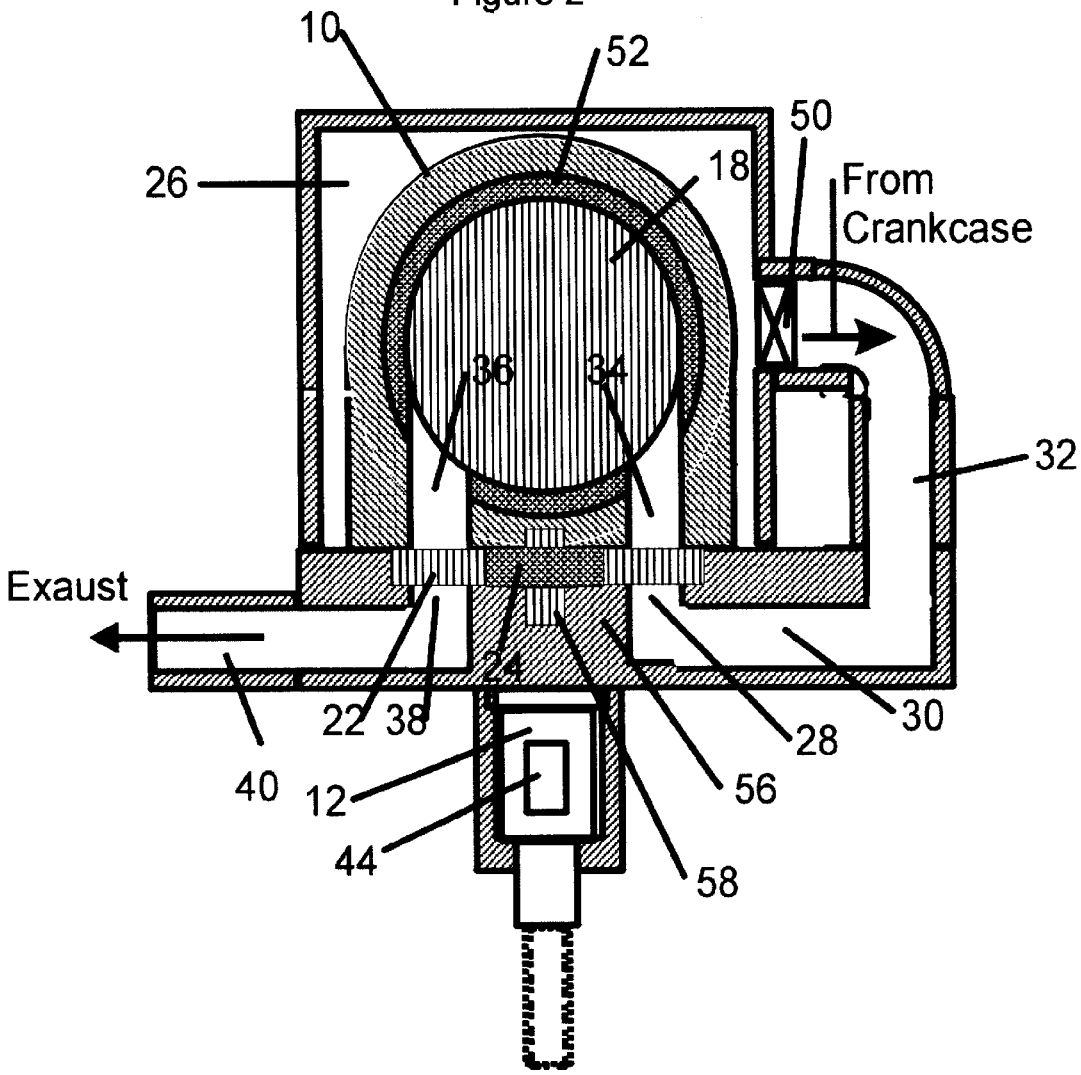
FIG. 2 is a view showing the relationship of the intake and exhaust passages of the instant invention.

As the hollow crankshaft 12 rotates counter-clockwise from the position shown in FIG. 1, the crankshaft intake port 44 in the hollow crankshaft 12 is positioned to close with respect to the engine housing port 42 in the engine housing 14, thereby sealing the crankshaft housing chamber or crankcase 26 and compressing the air-fuel mixture inside the crankshaft housing chamber 26, the chamber 32, channel 30 and port 28. As the piston 18 continues downward, the power gear 20 rotates the ported gear 22 causing the port 24 to present itself to the port 28 allowing the compressed air-fuel mixture to enter the passage 34 and into the cylinder compression chamber 48 when the piston 18 clears the port 34 as shown in FIG. 2. This completes the first downward stroke.

As the hollow crankshaft 12 continues to rotate in the counterclockwise direction, the piston rod 16 forces the piston 18 upward, passing the passage 34 therefore closing off the cylinder compression chamber 48 and compresses the air-fuel mixture. At this point the crankshaft intake port 44 presents itself to the engine housing port 42 in the engine housing 14 and allows the passage of air into the crankshaft housing chamber 26 along with aspirated fuel, and continues to allow the intake into the crankshaft housing chamber 26 until the piston 18 reaches the upper limit of its travel at the top. This completes the second stroke. The check valve 50 restricts any back flow into the crankshaft-housing chamber 26 during the second stroke.

The compression caused by the piston 18 heats the air-fuel mixture in the cylinder chamber causing the heating element in the glow plug 54 to ignite the air-fuel mixture, forcing the piston 18 into a downward power stroke. As the piston 18 passes the port 36, the expanded gasses pass through the port 36 on their way out of the engine. The port 24 in the ported gear 22 comes into position allowing the gasses to pass on through the port 38, the channel 40, and out to the atmosphere. The piston 18 is now at the extreme downward end of the third stroke. The crankshaft intake port 44 has been closed with respect to the engine housing port 42 throughout the complete third stroke and the air-fuel mixture has again been compressed in the crankshaft housing chamber 26, the chamber 32, channel 30 and port 28.

The port 24 in the ported gear 22 is still in position to allow any remaining burnt gasses to pass through the port 36 to the port 38 and from the cylinder chamber through the bypass 46 between the engine housing and the sleeve 52.

As the piston 18 starts its upward motion, it forces what remaining burnt gasses that are in the cylinder compression chamber 48 to pass out through the bypass 46 in the engine housing and the sleeve 52. The crankshaft intake port 44 is again in position with the engine housing port 42 to allow the air-fuel mixture to again fill the crankshaft housing chamber 26, while the check valve 50 restricts any back flow. This completes the fourth stroke.

What I claim as my invention is:

1. A four stroke internal combustion engine comprising: an engine block defining a crankcase and a cylinder, a hollow crankshaft in said crankcase and connected to a piston in said cylinder, a gear having a port and located on said block, said ported gear driven by a power gear on said crankshaft, a first passage in said cylinder for delivering an air/fuel mixture into said cylinder, a second passage in said cylinder for exhausting combustion products from said cylinder, and a third passage from said crankcase to said first passage; wherein said port sequentially opens and closes said first and second passages as the ported gear rotates.

2. The engine as set forth in claim 1, wherein said ported gear is twice the diameter of the said power gear.

3. The engine as set forth in claim 1, wherein said crankshaft and said block have ports adapted for receiving an air/fuel mixture, wherein as said crankshaft rotates said ports are aligned once per revolution and said mixture can flow through said hollow crankshaft into said crankcase.

4. The engine as set forth in claim 1, further comprising a glow plug in a cylinder head for igniting said mixture.

5. The engine as set forth in claim 1, further comprising a check valve in said third passage for allowing flow only from the crankcase to said cylinder.

6. The engine as set forth in claim 1, wherein said ported gear is secured between said block and a gear cover, said gear cover partially defining said third passage and a forth passage for exhausting combustion products from said second passage.

* * * * *